US008109712B2

(12) United States Patent
Ahmad et al.

(10) Patent No.: US 8,109,712 B2
(45) Date of Patent: Feb. 7, 2012

(54) METHOD OF PRODUCING A TURBINE OR COMPRESSOR COMPONENT, AND TURBINE OR COMPRESSOR COMPONENT

(75) Inventors: Fathi Ahmad, Kaarst (DE); Michael Dankert, Offenbach (DE)

(73) Assignee: Siemens Aktiengesellschaft, Munich (DE)

( * ) Notice: Subject to any disclaimer, the term of this patent is extended or adjusted under 35 U.S.C. 154(b) by 689 days.

(21) Appl. No.: 12/224,729

(22) PCT Filed: Jan. 24, 2007

(86) PCT No.: PCT/EP2007/050687
§ 371 (c)(1),
(2), (4) Date: Nov. 20, 2008

(87) PCT Pub. No.: WO2007/101743
PCT Pub. Date: Sep. 13, 2007

(65) Prior Publication Data

US 2009/0185913 A1 Jul. 23, 2009

(30) Foreign Application Priority Data

Mar. 6, 2006 (EP) ..... 06004535

(51) Int. Cl.
*F01D 5/14* (2006.01)
*F01D 5/18* (2006.01)
*F04D 29/58* (2006.01)
*B21D 53/78* (2006.01)
*B21K 3/04* (2006.01)

(52) U.S. Cl. ... 415/115; 416/95; 416/223 A; 29/889.721

(58) Field of Classification Search ..... None
See application file for complete search history.

(56) References Cited

U.S. PATENT DOCUMENTS 3,773,506 A * 11/1973 Larker et al. ..... 419/49
2003/0143075 A1 7/2003 Fleck
2005/0005910 A1 1/2005 Usui et al.

FOREIGN PATENT DOCUMENTS

EP 1 508 400 A1 2/2005
JP 53119268 A 10/1978
JP 54016015 A 2/1979
JP 01283301 A 11/1989
JP 07003469 A 1/1995
JP 08010848 A 1/1996

* cited by examiner

*Primary Examiner* — Scott B Geyer

(57) ABSTRACT

Disclosed is a turbine or compressor component with an integrated cooling channel, in particular a turbine blade, and a method for producing the same. The cooling channel of the component is subjected to internal pressure during a pressure impingement phase, the internal pressure being at a level sufficiently high that it causes the at least semiplastic deformation of the wall regions delimiting the cooling channel.

18 Claims, 1 Drawing Sheet

METHOD OF PRODUCING A TURBINE OR COMPRESSOR COMPONENT, AND TURBINE OR COMPRESSOR COMPONENT

CROSS REFERENCE TO RELATED APPLICATIONS

This application is the US National Stage of International Application No. PCT/EP2007/050687, filed Jan. 24, 2007 and claims the benefit thereof. The International Application claims the benefits of European application No. 06004535.8 filed Mar. 6, 2006, both of the applications are incorporated by reference herein in their entirety.

FIELD OF INVENTION

The invention relates to a method of producing a turbine or compressor component, in particular a blade, having at least one internal cooling passage. It also relates to such a turbine or compressor component.

BACKGROUND OF THE INVENTION

Turbine or compressor blades and turbine or compressor rotors are components subjected to both high thermal and mechanical loading. To reduce the thermal loading, which the materials used, in particular chrome steels or nickel-based alloys or the like, are exposed to during the operation of the turbine or of the compressor, such components are normally provided with internal cooling passages. A mostly gaseous or vaporous cooling medium, such as cooling air for example, flows through the cooling passages during operation, in the course of which mainly convective cooling is effected by heat transfer from the wall regions defining the respective cooling passage to the cooling medium flowing past. In order to achieve as uniform a cooling as possible of all the relevant regions of the component, e.g. a turbine blade, a meander-shaped course of the cooling passages or cooling air passages inside the component, in particular in the airfoils of turbine blades, is provided as a rule. On account of the restricted spatial conditions inside the airfoil, comparatively small cross sections and comparatively small radii of curvature are partly necessary.

Often used is an "open" cooling concept in which the cooling medium, after flowing through the respective cooling passage, leaves the component to be cooled via outlet passages branching off from the cooling passage and opening into outlet openings at the surface in order to be subsequently mixed with the hot working or flow medium flowing through the flow passage of the turbine or of the compressor. The outlet openings may be designed and arranged in particular like "film-cooling openings", such that the cooling medium flowing off from them flows along the surface of the component and in the process forms a cooling film protecting the surface material from direct contact with the hot and corrosive working medium.

Despite such polished and constantly refined cooling concepts, the thermal loading of turbine blades of gas or steam turbines is considerable. There is also the mechanical loading on account of the centrifugal forces which occur, in particular at the moving blades arranged on the turbine shaft and rotating at a high speed; but mechanical stresses on account of vibrations or impacts, etc., also often lead to pronounced loading. In particular during repeatedly occurring load alternation actions and in start-up and shutdown situations, in conjunction with variations in the speed of rotation, material fatigue phenomena occur during continued operation of the turbine or of the compressor despite novel materials optimized with respect to fatigue strength. Such fatigue phenomena in the form of microscopic cracks, etc., limit the period of use or the service life of the respective component.

A turbine blade described above and cooled in an open circuit is known, for example, from US 2003/143075 A1. To cool their trailing edge by blowing out turbulated cooling air, the turbine blades are provided with especially small blow-out holes which have been produced by means of a special method. This method provides for a mandrel contoured along its extent to be inserted into a hole provided in the trailing edge. The material of the trailing edge surrounding the holes is then plastically deformed by pressing together the outer walls of the trailing edge in such a way that contoured blow-out holes provided with turbulators remain behind after the removal of the mandrel. According to US 2003/143075 A1, care is to be taken here to ensure that the overall deformation of the turbine blade is minimal in order to keep the stress within its material as low as possible.

In addition, an autofrettage process for introducing residual compressive stresses into a pipe of a common-rail injection system is known from US2005/005910 A1.

On the whole, therefore, in the interest of operating reliability, comparatively frequent inspection and possibly exchange or renewal of the component are necessary, which involves undesirable downtimes and high costs. Since the service life of the turbine or compressor component of interest here can generally be estimated only with difficulty a priori, inspections carried out according to schedule, with service intervals estimated rather on the conservative side, i.e. service intervals selected to be rather short, often prove later to be unnecessary, since the material fatigue at the time of inspection has still not advanced as far as feared.

SUMMARY OF INVENTION

The object of the invention is therefore to specify a turbine or compressor component of the type mentioned at the beginning and a method of producing the same which ensure at least improved estimation of the service life of the component and in addition as far as possible also increased operating reliability and service life itself, in particular also under constantly alternating thermal and mechanical loading.

With regard to the method, the object is achieved according to the invention by an internal pressure being applied to the cooling passage during a pressurizing phase, said internal pressure being selected to be at such a level that it leads to an at least partially plastic deformation of the wall regions defining the cooling passage.

The invention is based on the idea that the service life, designated as LCF service life (LCF=Low Cycle Fatigue), of a turbine or compressor component, under alternating, cyclically occurring loads, is determined to a special degree by the distribution of the residual stresses within the component. In this case, it has been found that, in particular, the cooling passages running in a meander shape or serpentine shape, for example inside a turbine blade, can lead to a residual stress distribution reducing the fatigue strength. Especially in the vicinity of the reversal points of the serpentines, stress characteristics in which tensile stresses predominate over compressive stresses on average over time and space occur as a result of the comparatively small radii of curvature during the turbine operation, which involves exceptionally high load peaks. However, such tensile stresses as a rule reduce the LCF strength or the service life. It is therefore desirable to already provide at the production stage of the turbine components measures which counteract the tensile stresses normally accompanying the existence of the cooling passages. Such countermeasures should compensate for the tensile stresses at least partly, or even better should overcompensate for them and should displace the average stress characteristic, at least in the vicinity of the boundary wall enclosing the cooling passage, in the direction of compressive stresses.

For this purpose, according to the concept now present, subsequent treatment of the blade parent body, already provided with cooling passages and produced, for example, by a casting process, or of the other turbine or compressor component is provided, in which subsequent treatment an internal pressure which is substantially above the operating load to be expected later is applied during a pressurizing phase to the cooling passages or other cavities provided for the cooling air feed. At an appropriately selected level of the internal pressure, residual compressive stresses are produced in such a treated component in the wall regions adjoining the respective cavity, and these residual compressive stresses remain in existence even after the lowering of the pressure. During a pressure load exceeding the yield point or elastic limit of the material, the compressive stresses are caused by partial plasticization, i.e. permanent partially plastic deformations. The residual compressive stresses thus produced counteract already existing (production-related) tensile stresses or tensile stresses occurring during operation of the turbine or compressor component, as a result of which the endurance strength, in particular during cyclic loading, and thus the component service life to be expected are increased.

The method per se is already known in a quite different connection, namely in the treatment of gun barrels or of pressure-carrying cylindrical tubes, as "autofrettage"; an application to turbine or compressor components having integrated or embedded cooling passages has not been contemplated hitherto. As has surprisingly been found, the autofrettage, in particular in the case of internally cooled turbine moving blades, leads to a considerable increase in the LCF service life and in the resistance to vibration fatigue failure. In addition, the strength-reducing effect of stress peaks, which are produced, for example, by steps, transverse bores or processing errors, is reduced. Finally, the redistribution of the stress profile effected by the autofrettage is advantageous inasmuch as it makes it easier for the person skilled in the art to predict the service life of the turbine component to be expected under normal operating conditions, such that any inspection and service intervals can be planned and established in particular in keeping with requirements.

An internal pressure within the range of 500 bar to 10000 bar (1 bar=$10^5$ Pa=$10^5$ N/$m^2$) is advantageously set during the pressurizing phase. This ensures on the one hand that the application pressure is sufficiently high for a partially plastic deformation of the wall zones surrounding the respective cooling passage. On the other hand, bursting or tearing of the turbine or compressor component, or other damage thereto, as a result of excess pressure is safely avoided. The most favorable autofrettage pressure and the treatment duration greatly depend on the respective application, e.g. on the type of component to be treated and on the course of the cooling passages and possibly on other boundary conditions.

At least the wall regions defining the cooling passage are preferably heated to a treatment temperature above the room temperature directly before and/or directly after and/or during the pressurizing phase. A treatment temperature within the range of 30° C. to 1000° C. is preferably set. The temperature treatment can influence the physical effects underlying the elastic/plastic deformation in such a way that especially advantageous stabilization of the residual compressive stresses produced can be achieved after the autofrettage pressure drops.

A gaseous or liquid medium, in particular air, is preferably directed into the cooling passage of the component for the pressurizing, the intended internal pressure being generated by a suitable hydraulic or pneumatic device. The temperature of the application medium can expediently be regulated in such a way that said application medium brings about the already described advantageous heating of the entire component or at least of the zones adjoining the cooling passage. Alternatively, the pressurizing may also be effected by an ignitable gas mixture being directed into the cooling passage and being deliberately exploded therein.

Provided the component has a plurality of cooling passages which are not connected to one another, the autofrettage process is advantageously applied to each of the cooling passages. Alternatively, it may also be expedient, depending on the desired stress characteristic, to subject only some of the cooling passages to the pressure treatment.

The component to be treated is advantageously clamped or fastened in a clamping device or the like during the pressurizing phase so that it does not become distorted on its outer side. This is expedient in particular in the case of turbine blades, the aerodynamic properties of which depend on the exact profile shape of the airfoil. For example, such a blade, during the pressurizing phase and if need be during a preceding or subsequent temperature treatment phase, can be fixed like a sandwich between two pressure-stable mold shells adapted to the contour of the airfoil.

During the production of the component (e.g. a turbine blade), sectional passages which branch off from the cooling passage and open into outlet openings on the outer side and which are provided for film cooling of the outer side during subsequent operation are preferably not made in the component until after the pressure treatment phase. This has the advantage that the cooling passages or the sectional passages branching off therefrom do not first have to be laboriously sealed at their ends by means of sealing plugs before the pressurizing and then opened again, wherein it would be difficult anyway to achieve the tightness required for the abovementioned advantageous pressure conditions. Instead, according to the method proposed here, provision has to be made for appropriate sealing at most at the inlet opening for the application medium, which as a rule also constitutes the inlet opening for the cooling medium to be introduced later during operation. After the autofrettage treatment, the film-cooling holes or the comparatively short outlet passages passing through the blade wall rectilinearly as a rule can then be incorporated in the blade from outside, e.g. by laser drilling or by other suitable processes. The residual stress redistribution possibly effected in the process is insignificant, since it affects only the immediate surroundings of the outlet passages and can also be disregarded in terms of order of magnitude. Rather, it is important that the residual compressive stresses have been increased beforehand by the autofrettage treatment at the serpentines and deflections of the meander-shaped cooling air passages.

With regard to the turbine or compressor component, the object stated at the beginning is achieved by a turbine or compressor component having an internal cooling passage, wherein the wall sections or marginal zones defining the cooling passage, in the static state of the component, after pressurizing, are under such a compressive stress that tensile stresses occurring within these zones under dynamic loads during the operation of the turbine or of the compressor are at least partly compensated for, and are preferably completely compensated for, by the preset compressive stress characteristic. The respective component is in this case advantageously produced according the method described above, i.e. it has gone through, during production, a strengthening process accompanied by pressurizing of the cooling passage and partial plasticization of its wall regions.

The advantages achieved with the invention consist in particular in the fact that, by the deliberate introduction of compressive stresses in the internal wall zones, defining the cooling passages, of a turbine or compressor component, permanent redistribution of the residual stress characteristic in the component is effected, which has a favorable effect on the endurance and fatigue strength and therefore increases the service life of the component under the operating states occurring during subsequent operation.

BRIEF DESCRIPTION OF THE DRAWINGS

An exemplary embodiment of the invention is explained in more detail with reference to a drawing, in which.

DETAILED DESCRIPTION OF INVENTION

Figure 1:
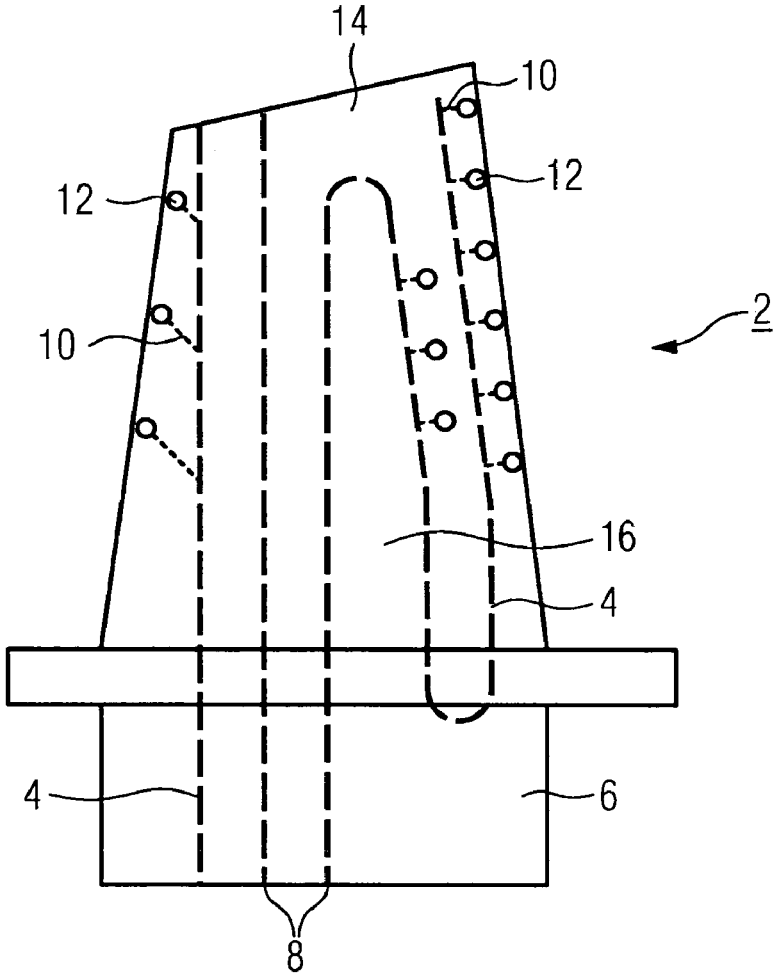
FIG. 1 schematically shows a turbine blade having internal cooling passages.

The moving blade 2 shown in FIG. 1 as an example of a component of a turbine has a plurality of cooling passages 4 which are directed in the blade interior and through which comparatively cold cooling air flows during the operation of the associated turbine. The cooling air is fed via inlet openings 8 arranged in the blade root 6. Once the cooling air has flowed through the partly meander-shaped and partly rectilinearly running cooling passages 4, in the course of which internal cooling of the turbine blades 2 is effected by mainly Convective heat transfer from the surrounding wall regions to the cooling air flowing past, the cooling air discharges through outlet openings 12, arranged in the blade surface, via outlet passages 10 branching off from the respective cooling passage 4 and forms in the process a cooling film protecting the blade surface from the hot working medium in the turbine. The outlet openings 12 may also be designed, for example, as film-cooling openings.

In turbine blades 2 of hitherto conventional type of construction, comparatively high tensile stresses occur during the turbine operation in marginal zones of the surrounding blade wall 14 which face the respective cooling passage 4, and these tensile stresses impair the fatigue strength, also designated LCF strength, and thus the service life of the turbine blade 2. To avoid such problems, according to the concept now provided, in a production stage of the turbine blade 2 in which the cooling passages 4 are certainly already formed in the blade interior but in which the outlet passages 10 branching off therefrom are not yet formed, an internal pressure which is well above the subsequent operating pressure is briefly applied once to the cooling passages 4. In the process, at the wall regions of the turbine blade 2 which adjoin the respective cooling passage 4, the yield point is exceeded and thus elastic/plastic deformation of the blade material occurs. On account of the plastic proportion of the deformation, local residual compressive stresses form in the blade wall 14 in the vicinity of the inner surfaces enclosing the cooling passage 4, and these residual stresses remain permanently in existence even after the pressurizing and thereby counteract the tensile stresses from the subsequent operating load. The thickness of the plastically deformed zones largely depends on the autofrettage pressure applied and the deformation properties of the blade material used.

Residual compressive stresses and residual tensile stresses are certainly in equilibrium as viewed globally, i.e. for the entire turbine blade 2, such that, during the application of the autofrettage, tensile stresses undesirable per se also form in the outer regions of the blade wall 14 in addition to the desired compressive stresses in the vicinity of the cooling passages 4; however, said tensile stresses can be distributed over larger spatial regions and in the process reach only comparatively small peak values. Thus such tensile stresses can be controlled substantially more effectively than the tensile stresses, with their comparatively high peak values, occurring in turbine blades of conventional type of construction.

Figure 2:
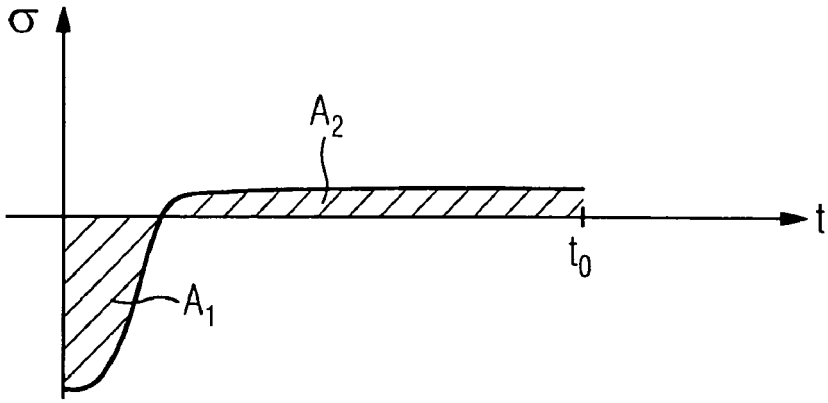
FIG. 2 shows a diagram in which a typical characteristic of the mechanical stresses is plotted against the expansion of a wall defining the cooling passage of the turbine blade according to FIG. 1.

The principle of the residual stress redistribution is illustrated schematically once again in FIG. 2. Here, the spatial characteristic of the residual stress 6 which results after the application of the autofrettage is plotted in the diagram against the wall expansion t. In this case, it is assumed that the cooling passage lies in the region of negative t values and is defined by an inner wall at t=0. The outer wall of the turbine blade lies at $t=t_0$. The variable t itself designates the spatial expansion of the blade wall 14, e.g. perpendicular to the surface of the airfoil 16. The compressive stresses present close to t=0, the magnitude of which is greatest at t=0 (that is to say at the inner wall), are provided with a negative sign. Tensile stresses (positive sign of $\sigma$) are present further outside on account of the global stress equilibrium, but said tensile stresses are distributed over a larger spatial region and therefore assume substantially smaller values than the compressive stresses. The two areas $A_1$ and $A_2$ enclosed by the stress Characteristic curve and the t axis are the same size, i.e. $A_1=A_2$.

In the exemplary embodiment, the comparatively high autofrettage pressure of, for example, 1000 bar to 5000 bar is applied by the inlet openings 8 in the blade root 6 of the turbine blade 2 being connected via pressure-resistant connecting lines to a pressure reservoir (not shown here) or to another suitable pressure-generating device, wherein, after an overflow valve has been opened, an application medium under high pressure flows into the system of cooling passages 4 of the turbine blade 2 and in the process produces the partially plastic deformations of the internal wall regions. Alternatively, pressurizing may be provided by causing one or more explosions of an ignitable gas mixture inside the cooling air passages, preferably with inlet openings 8 closed. After pressurizing has been effected, which if need be is carried out at an increased temperature of the turbine blade 2, the outlet passages 10 are subsequently made through the blade wall 14 from outside and the turbine blade 2 is thus completed. If need be, the turbine blade 2 is also coated with a thermal barrier coating (TBC).

The invention claimed is:

1. A turbomachine blade, comprising:

a base material;

a root portion; and a blade portion arranged on top of the root portion, wherein the root and blade portions comprise an internal cooling passage that runs within the root and blade portions and the cooling passage is delimited by wall sections where the wall sections are pre-stressed due to an internal pressurizing of the cooling passage such that compressive residual stresses remain in the material of the wall section after pressurizing, and where operative dynamic tensile loads are at least partially compensated by the residual compressive stress.

2. The turbomachine blade as claimed in claim 1, wherein the internal pressure is between 1000 bar to 5000 bar.

3. The turbomachine blade as claimed in claim 2, wherein a gaseous or liquid medium is directed into the cooling passage for the pressurizing and the desired internal pressure is generated by an external pressure-generating device.

4. The turbomachine blade as claimed in claim 2, wherein the internal cooling passage is pressurized by via igniting an ignitable mixture.

5. A thermal turbomachine, comprising:

a rotably mounted shaft arranged along a rotational center line of the turbomachine;

a stationary casing that surrounds and is arranged coaxially with the shaft; and a plurality of blades arranged on the shaft, wherein the blades comprise:

a base material, a root portion, and a blade portion arranged on top of the root portion, wherein the root and blade portions comprise an internal cooling passage that runs within the root and blade portions and the cooling passage is delimited by wall sections where the wall sections are pre-stressed due to an internal pressurizing of the cooling passage such that compressive residual stresses remain in the material of the wall section after pressurizing, and where operative dynamic tensile loads are at least partially compensated by the residual compressive stress.

6. The turbomachine as claimed in claim 5, wherein the internal pressure is between 1000 bar to 5000 bar.

7. The turbomachine as claimed in claim 6, wherein a gaseous or liquid medium is directed into the cooling passage for the pressurizing and the desired internal pressure is generated by an external pressure-generating device.

8. The turbomachine as claimed in claim 6, wherein the internal cooling passage is pressurized by via igniting an ignitable mixture.

9. A method of producing a turbine or compressor blade having an internal cooling passage, comprising:

providing an internal cooling passage within the blade wherein the cooling passage has wall regions that define the cooling passage;

applying an internal pressure to the cooling passage during a pressurizing phase where the internal pressure is selected at a magnitude such that the internal pressure results in an at least partially plastic deformation of the wall regions;

directing an ignitable gas mixture into the cooling passage;

closing inlets and outlets of the cooling passage; and igniting the mixture with inlet and outlet openings closed.

10. The method as claimed in claim 9, wherein the internal pressure is between 500 bar to 10000 bar.

11. The method as claimed in claim 10, wherein the internal pressure is between 1000 bar to 5000 bar.

12. The method as claimed in claim 10, wherein at least the wall regions defining the cooling passage are heated to a treatment temperature above a room temperature directly before the pressurizing phase.

13. The method as claimed in claim 10, wherein at least the wall regions defining the cooling passage are heated to a treatment temperature above a room temperature directly before and/or directly after the pressurizing phase.

14. The method as claimed in claim 10, wherein at least the wall regions defining the cooling passage are heated to a treatment temperature above a room temperature directly before and/or directly after and/or during the pressurizing phase.

15. The method as claimed in claim 12, wherein the treatment temperature is between 30° C. to 1000° C.

16. The method as claimed in claim 15, wherein a gaseous or liquid medium is directed into the cooling passage for the pressurizing and the desired internal pressure is generated by an external pressure-generating device.

17. A method of producing a turbine or compressor blade having an internal cooling passage, comprising:

providing an internal cooling passage within the blade wherein the cooling passage has wall regions that define the cooling passage;

applying an internal pressure to the cooling passage during a pressurizing phase where the internal pressure is selected at a magnitude such that the internal pressure results in an at least partially plastic deformation of the wall regions;

directing an ignitable gas mixture into the cooling passage;

closing inlets and outlets of the cooling passage; and igniting the mixture with inlet and outlet openings closed, wherein at least the wall regions defining the cooling passage are heated to a treatment temperature above a room temperature directly before the pressurizing phase, and wherein the treatment temperature is between 30° C. to 1000° C.

18. The method as claimed in claim 17, further comprising:

forming outlet passages in the blade that branch off from the cooling passage and open into outlet openings on the outer side after the pressure treatment phase.

* * * * *